United States Patent [19]

Desmouliere

[11] Patent Number: 5,005,870

[45] Date of Patent: Apr. 9, 1991

[54] PROCESS AND APPARATUS FOR INDUSTRIAL BOOKBINDING AND BINDING THEREBY OBTAINED

[75] Inventor: Georges Desmouliere, Sainte Savine, France

[73] Assignee: 501 Sirc Societe Industrielle de Reliure et de Cartonnage, Paris, France

[21] Appl. No.: 210,098

[22] Filed: Jun. 22, 1988

[30] Foreign Application Priority Data

Jan. 6, 1988 [FR] France ..... 88 00054

[51] Int. Cl.[5] ..... B42D 1/06; B42D 3/00

[52] U.S. Cl. ..... 281/21.1; 281/15.1

[58] Field of Search ..... 281/34, 42, 15.1, 21.1; 412/5, 19, 20, 21

[56] References Cited

FOREIGN PATENT DOCUMENTS

| | | | |
|---|---|---|---|
| 536195 | 3/1955 | Belgium | 281/34 |
| 1193010 | 5/1965 | Fed. Rep. of Germany | 281/34 |
| 1236215 | 6/1960 | France | 281/34 |
| 1396447 | 3/1965 | France | 281/34 |

*Primary Examiner*—Paul A. Bell

*Attorney, Agent, or Firm*—Wolf, Greenfield & Sacks

[57] ABSTRACT

A bookbinding process for producing a flexible book case, and an apparatus for making books according to the process. The book case is one-piece, having a front panel (1) a rear panel (3) and a spine (2). The book case has at least one leaf (4, 5) joined to the case and at least one scored line (8–13) forming a fold and hinge line between the leaf (4, 5) and the corresponding panel. The bookbinding process and apparatus are particularly designed for industrial bookbinding.

4 Claims, 3 Drawing Sheets

PROCESS AND APPARATUS FOR INDUSTRIAL BOOKBINDING AND BINDING THEREBY OBTAINED

The present invention relates to an industrial bookbinding apparatus and a process for using same, and to the binding so produced.

Industrial bookbinding techniques have been known for many years. In the case of certain types of binding, these techniques have evolved away from a binding with a rigid cover (case) towards a binding with a flexible case, in which the spine and the front and back panels of the case are produced in a single piece articulated along the hinges of the spine.

The requirements which the industrial binding has to satisfy are conflicting requirements of quality and price.

The development of the binding known as the "integra" binding has enjoyed great success, for books bound with it, being flexible, are confortable to hold. These bindings are suitable both for books of the novel or essay type, etc. that are seldom handled, and for books in current use that are handled frequently, such as guides, lexica, technical books, etc..

In these "integra" bindings, the dust jacket in bindings with rigid cases, is integrated with the case both for technical and financial reasons.

This is because a dust jacket is expensive owing to the cost of manufacturing it and placing it in position once the book has been bound, the latter operation having to be performed by hand at the end of the production line.

The "integra" binding cannot take a dust jacket because the latter would not sit properly on the flexible case. Moreover this would be contrary to the spirit of the "integra" binding, which has to be less expensive than the traditional industrial bindings.

Omitting the dust jacket also does away with one advantage that is highly thought of by readers, for often the leaf or leaves of the jacket are used as a bookmark, something that is missing from most industrially bound books, again to reduce manufacturing costs.

It is the object of the present invention to provide a process and a binding apparatus enabling "integra" bindings to be produced on an industrial basis while giving said bindings certain important advantages of the more traditional bindings with dust jackets.

To this end, the invention relates to a binding of the foregoing type which is characterised in that it comprises at least one leaf joined to the blank constituting the case and at least one scored line forming a fold and hinge line between the leaf and the corresponding panel.

This binding is particularly easy to produce since the leaf or leaves are joined to the blank, constituting the case.

Since the leaf is joined to the case, only one leaf need be provided, unlike the jacket which has to be held by two leaves.

However, for practical reasons it is preferably if the case has two leaves, which in the case of, say, a guidebook or a book that is referred to frequently for only one section of its pages, enables the particular section in use to be isolated for easier access.

In addition, the leaf or leaves may carry information such as an explanation of the symbols used (for instance in a guide) or a list of terms used in the book, etc..

Of particular interest is the fact that where the book is of a certain thickness the binding has a plurality of fold lines between the leaf and the case. This makes it easier to keep the leaf between the pages of the book since there is not just one hinge, but at least two hinges between the leaf and the case, the distance between said hinges corresponding to some extent to the thickness of the wad of pages held between the case and the leaf.

According to another feature the leaf has slantwise edges, making the free side of the leaf shorter than the fold line of the leaf.

This form of leaf is of special interest from the point of view of both its manufacture and its use because there is no danger of the leaf jutting out past the edge of the case even if the fold line is not exactly perpendicular to the edge of the case or if the leaf has become deformed through use.

According to another feature, the case is made up of a flexible blank, onto which a covering material is glued externally.

The invention further relates to a process for manufacturing a binding of the foregoing type, said process involving assemblying the sheets to produce the body of the book, producing the case by cutting out and scoring a blank of suitable material and, if necessary, glueing a backing onto the blank constituting the support material, glueing the body of the book placed astride a vertical support plate, putting the case in place, and returning the book furnished with the case to be passed, its spine facing down, through the press.

In accordance with the invention, said process is characterised by producing a case having at least one leaf intergral with the case and, at least at the join, a scored line, supporting the body of the book by the front, on either side, of the glueing support plate, pressing the rear side of the book against a tipping plate, blowing a jet of air against the front panel of the case to hold the corresponding leaf in position, tipping the book to lay it flat while continuing to blow against the front panel for at least part of the tipping movement.

This manufacturing process enables a book to be bound by industrial methods with the "integra" case equipped with leaves in accordane with the invention, without the danger of said leaves becoming damaged during manufacture, either by the weight of the book being bound, or by the traditional components of the production line.

The invention also relates to an apparatus for carrying out the foregoing process, said apparatus comprising: a glueing station which receives the bodies of the books and the cases, and equipped with a vertical plate conveyor, each plate receiving a book body placed astride the plate so that the spine of the book body faces upwards, the pages of the book body hanging down on either side of the plate; a glueing device for applying glue to the spine; a device for positioning the case on the glue-coated spine; a tipping station for laying flat each book body equipped with its case on leaving the glueing station, said tipping station comprising a tipping plate between a vertical position and a downwardly hinged position, said plate receiving the book coming from the glueing stage, in a vertical position, to support it while the support plate is withdrawn and tip it into a horizontal position.

In accordance with the invention, this apparatus is characterised by comprising a lower support device formed by at least one support member coming from one side (or from both sides) of the path taken by the support plates, said device being constrained to move with the hingeing plate and it supports the book by the front edge, an air jet nozzle directed at the front panel of the book in the tipping station blowing a jet of air against the front panel of the book for, at least, part of the tipping movement between the vertical position and the position in which the book lies flat to support the case, thereby preventing the corresponding leaf from folding frontwards.

In the apparatus of the invention, the body of the book is supported by the glueing plate, which supports it until it reaches the hingeing station, without, at any time during the passage of the book through the apparatus, any danger of the leaves which are not yet folded along the scored lines leaving the plane of the part of the case at which said leaves are folded.

The apparatus also enables the supporting plate to move away from the book once it has been glued, without the book resting on the leaves.

Depending on whether the book has a straight or rounded spine and front edge, the supporting member or members will have a corresponding shape to ensure that at no time is the book resting against a shape different from its own.

The present invention will now be detailed with reference to the accompanying drawings, wherein.

Figure 1:
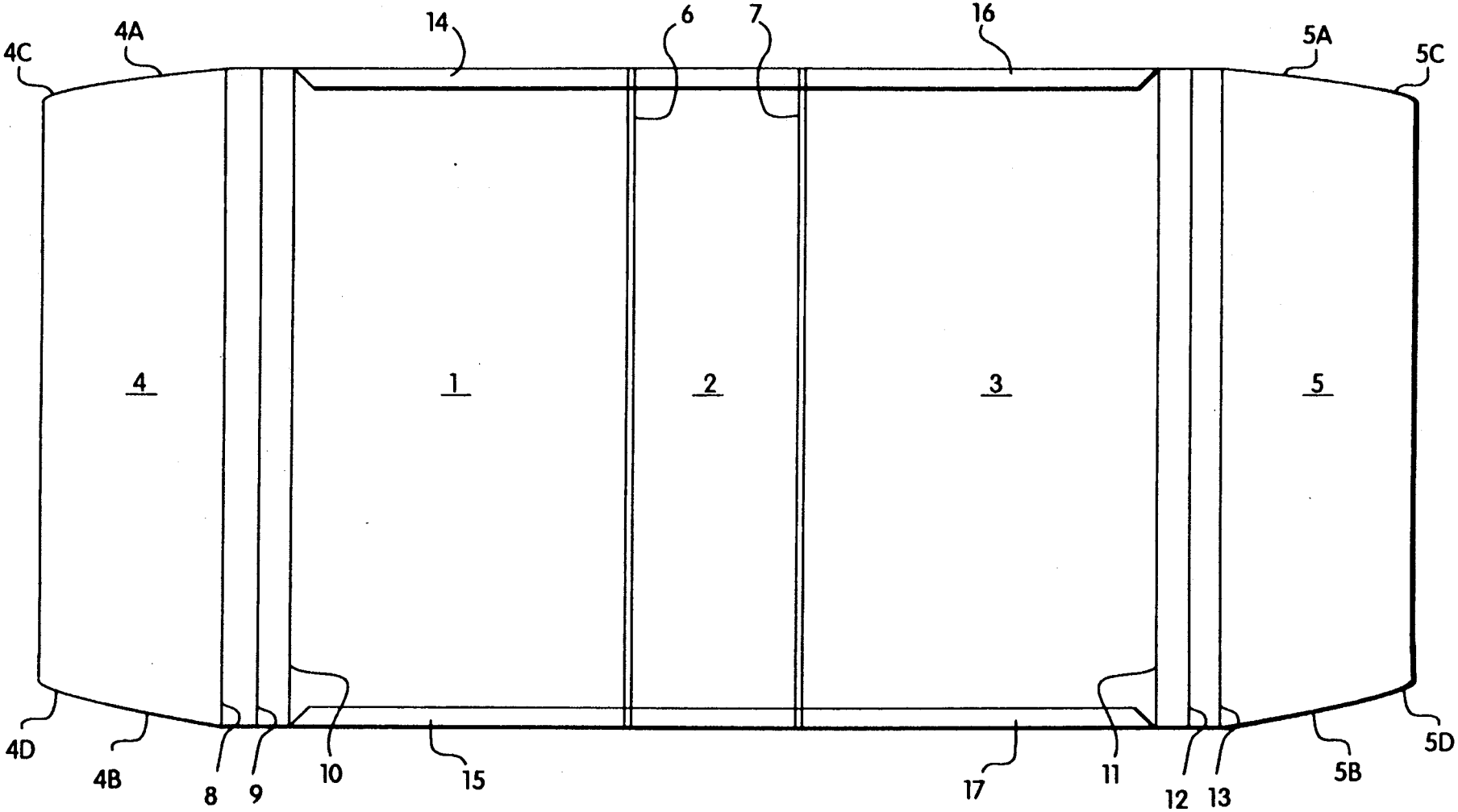
Fig. 1 is a top view of a bookbinding case according to the invention in the perfected state.

According to FIG. 1, the binding of the invention is made up of a case comprising a front panel 1, a spine 2 and a rear panel 3. The front panel 1 and the rear panel 3 are respectively extended by a leaf 4, 5. Each leaf is trapezoidal in form, with the result that sides 4A, 4B and 5A, 5B go to a point and terminate at the front edge in rounded corners 4C, 4D and 5C, 5D.

Panels 1 and 3 are joined to the case by scored fold lines 6, 7. Leaves 4, 5 are joined to panels 1, 3 by scored lines 8–10 and 11–13 which form either hinges or leaf fold lines enabling the leaves to be adapted to the thickness of the wad of sheets to be held. In this way the leaf is introduced more or less flat between the sheets of the closed book and there is no risk of it escaping therefrom, as there is with a single fold line.

The foregoing case is produced from a single blank of more or less limp material such as light cardboard. This blank may be covered externally with a suitable material, the hinged parts 16, 17 of which can be seen in FIG. 1.

The bookbinding process and apparaus according to the invention will now be described with reference to the schematic drawings in FIGS. 2 and 3A to 3C.

Figure 2:
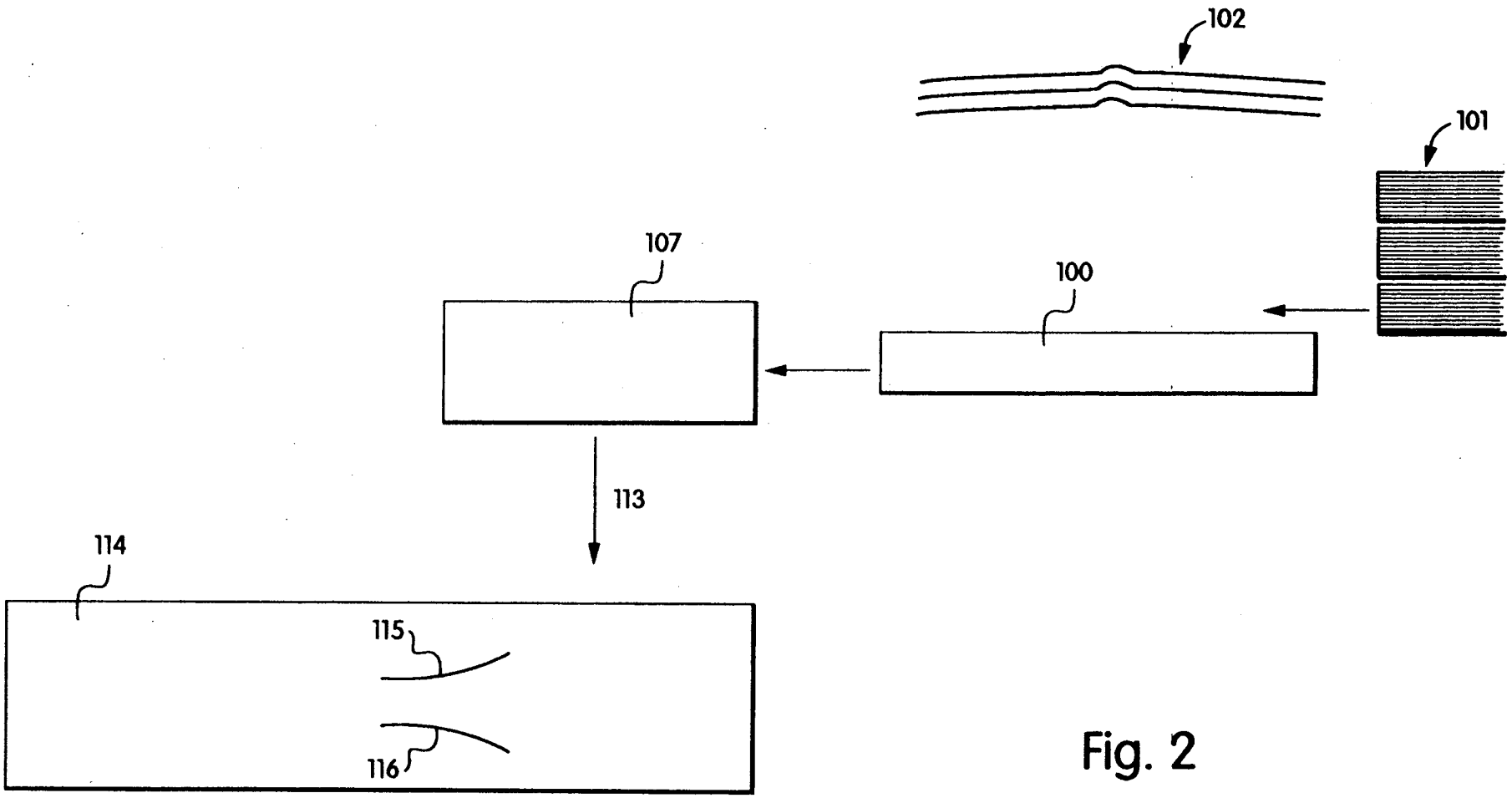
FIG. 2 is a skeleton diagram of part of the industrial bookbinding apparatus according to the invention.

In FIG. 2, the industrial bookbinding apparatus for producing bindings such as that made with the foregoing case consists of a glueing station 100 which receives the book bodies 101 and the cases 102 to join them together.

The glueing station is equipped with a conveyor 103 with vertical plates 104, astride which the book bodies 101 are placed and their spines 106 glued, after which the cases 102 are put in position. The plates 104 are sufficiently high for the leaves 102A, 102B to hang down.

Figure 3C:
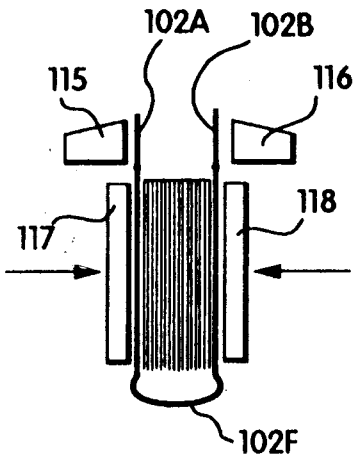
FIG. 3C is a schematic cross-section of the book in the presses.
Figure 3B:
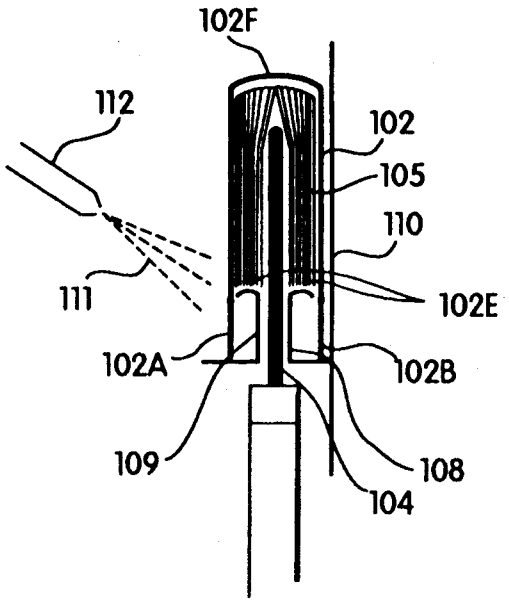
FIG. 3B is a schematic cross-section showing the arrangement of the book and how it is supported in the hingeing station.
Figure 3A:
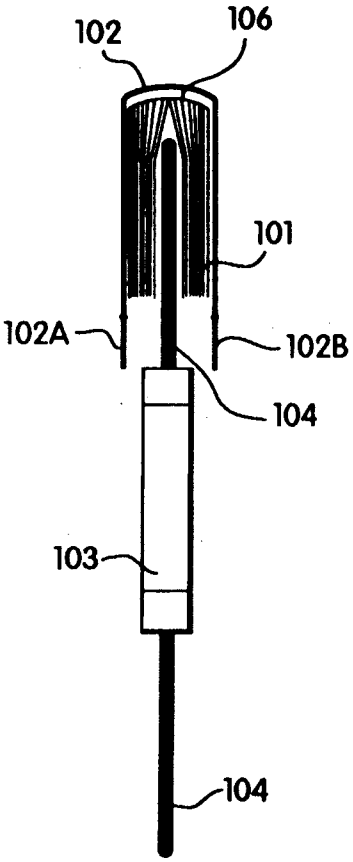
FIG. 3A is a cross-section of a book mounted on a support plate for glueing.

The glueing station 100 is followed by a hingeing station 107, at which the conveyor 103 arrives with the support plates 104 carrying the glued books. In this station the plates 104 detach themselves from the books and the latter are tipped from the vertical position to the horizontal position as shown in FIG. 3B.

In this tipping station, each book 101, 102 comes to rest on a lower support device formed, in this instance, by two members 108, 109 situated one either side of the path of the vertical plates 104 and allowing said plates 104 to be retracted. As they travel downwards, the plates 104 therefore being the front edge 102E of the book to rest on the upper lips of the supporting members 108, 109. These supporting members 108, 109 are sufficiently high for the leaves 102A, 102B not to be supported. In this tipping station the book also rests against a rear plate 110 and the front face is subjected to the action of an air jet 111 emitted by a nozzle 112. In this way the front leaf 102A is kept aligned for the entire tipping movement. The nozzle 112 operates for part of the tipping movement of the book linked between the vertical position and the horizontal position.

After the tipping station 107, a horizontal conveyor 113 carries the books into the pressing station 114. The books pass in a vertical position into the presses 114 (see FIG. 3C), their spine 106 at the bottom and their front edge 102E at the top. At the entrance to this pressing station are two lateral guides 115, 116, which guide the leaves 102A, 102B so that the latter do not knock against obstacles or become incorrectly folded. Finally, presses 117, 118 operate on the body of the book and compress the glued areas.

I claim:

1. A book comprising:

a book block having pages of a predetermined size; and a case comprising a front panel, a rear panel and a spine with said book block being permanently secured to said case such that said book block is interposed between said front and rear panels, said front and rear panels being approximately the same size as said predetermined size, and said front and rear panels having upper, lower and side free edges;

said case further comprising at least one leaf integral with and extending beyond one of said free edges of said front or rear panel and being foldable toward said pages of said book block so as to function as a bookmark.

2. The book according to claim 1, characterised by having two leaves.

3. The book according to claim 1, characterised by a plurality of scored fold lines (8–13) between the leaf (4, 5) and the corresponding panel (1, 3).

4. The book according to claim 1, characterised in that the leaf (4, 5) is trapezoidal in shape with the result that the free side of the leaf (4, 5) is shorter than the corresponding side of the leaf that is integrally joined to the corresponding panel (1, 3).

* * * * *